United States Patent [19]

Nakagawa et al.

[11] Patent Number: 5,040,398

[45] Date of Patent: Aug. 20, 1991

[54] CERAMIC SLEEVE INCORPORATED ROLLING ROLL

[75] Inventors: Mitsuo Nakagawa, Mito; Mitsuo Taguchi, Iwaki; Hiromi Kagohara, Hitachi, all of Japan

[73] Assignee: Hitachi, Ltd., Tokyo, Japan

[21] Appl. No.: 422,098

[22] Filed: Oct. 16, 1989

[30] Foreign Application Priority Data

Oct. 14, 1988 [JP] Japan ..... 63-257106

[51] Int. Cl.[5] ..... B21B 27/02

[52] U.S. Cl. ..... 72/199; 72/252.5; 29/123; 29/125; 29/132

[58] Field of Search ..... 72/199, 252.5; 29/122, 29/123, 125, 127, 129, 129.5, 132, 121.6

[56] References Cited

U.S. PATENT DOCUMENTS

| | | | |
|---|---|---|---|
| 1,289,602 | 12/1918 | Baehr | 29/121.6 |
| 3,577,619 | 5/1971 | Strandel | 29/125 |
| 4,105,264 | 8/1978 | Zimmermann et al. | 29/121.6 |
| 4,115,910 | 9/1978 | Hertel et al. | 29/123 |
| 4,924,688 | 5/1990 | Cutmore | 72/199 |

FOREIGN PATENT DOCUMENTS

| | | | |
|---|---|---|---|
| 2317620 | 10/1974 | Fed. Rep. of Germany | 29/132 |
| 2902825 | 3/1980 | Fed. Rep. of Germany | 29/125 |
| 0165107 | 10/1982 | Japan . | |
| 0001009 | 1/1984 | Japan . | |
| 0035816 | 2/1984 | Japan . | |
| 0083708 | 5/1985 | Japan . | |

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

A rolling roll comprises a metal rolling roll body, a ceramic sleeve into which the roll body is inserted with a gap therebetween, thereby providing a working surface of ceramics at an outer periphery thereof, fasteners provided on the roll body at both sides of the sleeve for pressing the side faces of the sleeve thereby to fix the sleeve to the roll body, and at least one spacer having a larger coefficient of thermal expansion than that of the roll body and inserted between the sleeve and the fastener so that the sleeve is axially pressed by the fastener to fix the sleeve to the roll body.

10 Claims, 2 Drawing Sheets

CERAMIC SLEEVE INCORPORATED ROLLING ROLL

BACKGROUND OF THE INVENTION

This invention relates to a rolling roll into which a sleeve of a high wear-resistance is incorporated to provide a working surface and, more particularly, a ceramic sleeve incorporated rolling roll wherein a ceramic sleeve is fitted on an arbor or a metal rolling roll body and improved so as not to cause displacement between the ceramic sleeve and the metal rolling roll body even if the rolling roll is raised in temperature during rolling, and a rolling mill into which the above-mentioned rolling roll is employed.

Recently, many attempts have been made to improve wear resistance of a rolling roll, as a result, many kinds of roll construction materials, that is, bearing steel, die steel, high speed steel and a special material such as tungsten carbide are used. Further, ceramics also has been used as material for rolling rolls. The ceramics is hard and has a sufficient wear resistance and a strong resistance against compression stress, however the ceramics is lacking in strength against tensile stress. Further, cemented carbide and ceramics cost higher than metal, therefore, it is desirable that they are used only in a portion of the rolling roll is in direct contact with material to be rolled during rolling and required to have wear resistance. Further, it is difficult to produce a large scale rolling roll of ceramics, so that sleeve-assembled rolling rolls have been used in order to solve the above-mentioned defect.

However, as mentioned above, since the ceramics is not strong against tensile stress, a conventional assembling method such as shrinkage fit, press fit, etc. can not be employed. In case the conventional assembling method is employed in assemblage of a ceramic sleeve and a rolling roll body, since the thermal expansion coefficient of ceramics is much smaller than a metal roll body, tensile stress is produced in the ceramic sleeve when the rolling roll temperature is raised during rolling, which results in early breakage of the ceramic sleeve.

Therefore, an assembling method wherein compression is previously added to a cemented carbide or ceramic sleeve has been developed.

There are various examples of such assembling methods, one of which is a method wherein a pressure chamber is provided between an end portion of a sleeve and a supporting member for fixing the sleeve, and the sleeve is fixed by pressure in the pressure chamber, which assembling method is disclosed in Japanese Patent Laid-Open Nos. 57-165107 (1982) and 59-1009 (1984). Another is a method wherein an average thermal expansion coefficient of a hard sleeve and a separate ring is made smaller than that of a rolling roll body, the sleeve and separate ring are assembled in the rolling roll body in a state that the rolling roll is extended more than the sleeve and the separate ring by raising the temperature thereof during assemblage, and compression stresses are applied on the sleeve sides when the assembled roll is cooled, whereby the sleeve is fixed, which is disclosed in Japanese Patent Laid-Open No. 59-35816 (1984). And still another is a method wherein a spacer which has a thinner effective thickness at time of thermal expansion than when shrank is used between a sleeve and a fixing device such as a nut, the spacer in a state of thermal expansion is assembled into a rolling roll body together with the sleeve, a disc spring, etc. and fixed by the nut, and then the spacer shrinks radially thereby to increase the deformation of the disc spring and give compression force on the side of the sleeve, which is disclosed in Japanese Patent Laid-Open No. 60-83708 (1985).

In the above-mentioned conventional techniques, a maximum constraining force for the sleeve is provided at a low temperature, the constraining force becomes weak as the temperature of the rolling roll rises, and the constraining force disappears when the temperature further increases, which results in free movement of the sleeve.

SUMMARY OF THE INVENTION

An object of the invention is to provide a rolling roll which is incorporated with a sleeve having a high wear resistance and a smaller coefficient of thermal expansion than that of a rolling roll body to provide a working surface, and which constraining force of the sleeve does not decrease even when temperature of the rolling roll rises.

Another object of the invention is to provide a ceramic sleeve incorporated rolling roll of a construction wherein constraining force for fixing the ceramic sleeve to the rolling roll body does not decrease even when the temperature of the roll rises and a rolling mill which has such rolling roll incorporated therein.

The present invention resides in a rolling roll comprising: a metal rolling roll body; a sleeve into which the roll body is inserted with a gap therebetween, thereby providing a working surface at an outer periphery thereof, the sleeve being made of material having a smaller coefficient of thermal expansion than that of said roll body and a high wear resistance; fixing means provided on the roll body at both sides of the sleeve for pressing the side faces of the sleeve thereby to fix the sleeve to the roll body; and at least one spacer having a larger coefficient of thermal expansion than that of the roll body and inserted between the sleeve and the fixing means so that the sleeve is pressed by the fixing means to fix the sleeve to the roll body.

Most desirable material for the above-mentioned sleeve is ceramics.

In general, the ceramics has a smaller coefficient of thermal expansion than structural steel used for the rolling roll body irrespective of kinds of ceramics as structural material. In the invention, the spacer having larger coefficient of thermal expansion than the rolling roll body is disposed between the sleeve such as ceramic sleeve and one of fixing devices provided on the rolling roll body for fixing the ceramic sleeve to the rolling roll body, and the ceramic sleeve and the spacer are axially pressed by the fixing devices so that the sleeve is fixed to the rolling roll body. Under the fixed condition, an amount of thermal expansion of the sleeve plus the spacer becomes slightly larger than that of a part of the rolling roll body corresponding to the axial length of the sleeve and the spacer when the roll temperature rises, so that the sleeve is always firmly fixed to the rolling roll body without causing the sleeve to move relatively to the rolling roll body.

BRIEF DESCRIPTION OF THE INVENTION

DETAILED DESCRIPTION OF THE INVENTION

Figure 1:
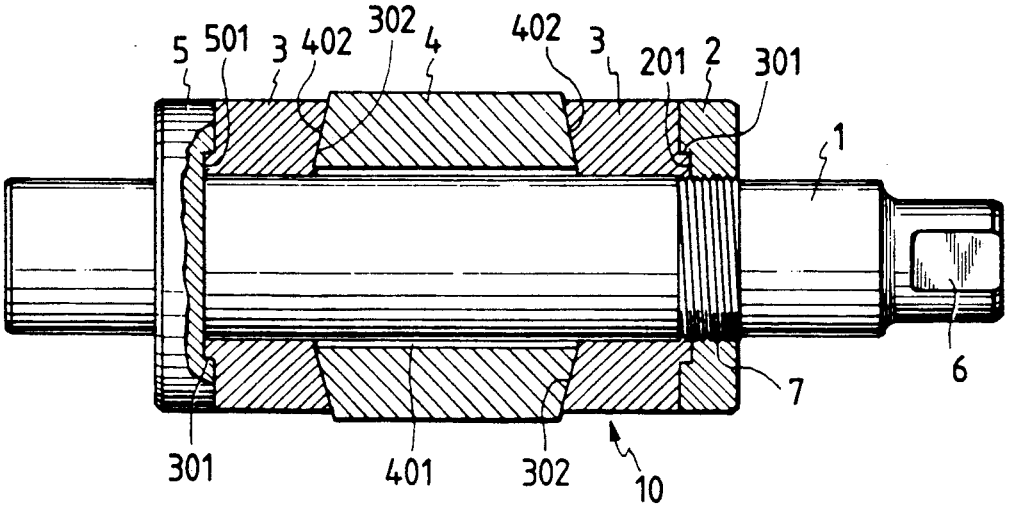
FIG. 1 is a sectional view of an embodiment of a ceramic sleeve incorporated rolling roll according to the invention.

The present invention comprises an arbor as a rolling roll body, a high wear-resistant sleeve such as a ceramic sleeve, at least a spacer provided on one of sides of the sleeve so as to contact the side of the sleeve and fixing means such as fasteners provided on the rolling roll body for axially pressing the sleeve and the spacer on one of the fasteners by the other fastener thereby fixing the sleeve to the rolling roll body.

Assuming that the linear expansion coefficient and the axial length of the ceramic sleeve are $\alpha_1$, $l_1$, the linear expansion coefficient and the axial length of the spacer are $\alpha_2$, $l_2$, and the linear expansion coefficient of the rolling roll body is $\alpha_3$, in case the temperature of the entire rolling roll body rises, the conditions that constraining force given to the sleeve during assemblage of the rolling roll is maintained are as follows:

$$\alpha_1 l_1+\alpha_2 l_2 \geqq \alpha_3 (l_1+l_2).$$

In the above relation, in case an equal sign is valid, the constraining force does not change even if there is change in temperature, and if the rolling roll is designed so that unequal sign is valid, the constraining force increases as the temperature of the roll rises. In this case, however, the constraining force should be within the compression yield strength of the sleeve, and fixing force such as thread strength of a screw.

In view of the above-mentioned, metal, compound material can be used as structural material of the spacer, for example. Aluminum-and copper-alloys such as duralumin, Lo-Ex, brass, AHS etc. are candidates of the metallic material.

Further, in case of production of a large size sleeve to be incorporated in the roll body, it is desirable for preventing deviation of the sleeve in a radial direction of the rolling roll when the temperature of the rolling roll rises that thermal expansion coefficient of the spacer in a radial direction is close to the thermal expansion coefficient of the sleeve. The demand is satisfied by a material having a large anisotropic thermal expansion coefficient. As such a material, a fiber compound metal in which low thermal expansion fiber is oriented in a radial direction can be effectively used. For example, Al-C fiber compound metal in which C-fiber of 50% is oriented in Al has a linear expansion coefficient of $6.2\times10^{-6°}$ C.$^{-1}$ in a radial direction and of $21.8\times10^{-6°}$ C.$^{-1}$ in an axial direction. The material is favorable to constrain the sleeve to the rolling roll body.

It is desirable that the inner periphery of the ceramic sleeve is not in contact with the rolling roll body and the side faces of the ceramic sleeve are fixed to the rolling roll body through the spacer.

It is further desirable that the ceramic sleeve is fixed so as to be kept concentric with the axis of the rolling roll body even during rolling. In order to keep the sleeve and the rolling roll body concentric with each other, contact faces between the sleeve, the spacer and the fixing devices are formed in a shape other than a flat face. Examples of the shape of in the contact faces are a taper face, an arc face, a stepped face, etc.

At least one of the fasteners is one for effecting shrinkage fit, press fit, adhesion or screw fastening.

The spacer will be described further in detail hereunder.

The linear expansion coefficient of structural steel is about $12.0\times10^{-6°}$ C.$^{-1}$. Ceramic material has a linear expansion coefficient smaller than the steel and about $\frac{1}{4}$ to $\frac{1}{2}$ times one of the steel. Therefore, it is desirable for the spacer to have a linear expansion coefficient as large as possible. However, it is desirable for Young's modulus and yield strength to be large in addition to the linear expansion coefficient, so that organic material can not be used and metal material excellent in these properties should be selected.

The materials and their characteristics for the spacer tested upon practice of the invention are given in the following table.

| Characteristics | Material | | | |
|---|---|---|---|---|
| | duralumin *1 | Lo-Ex *2 | brass *3 | AHS *4 |
| Linear expansion coefficient ($\times 10^{-6}$ °C.$^{-1}$) | 23.5 | 19.8 | 18.4 | 20.5 |
| Young modulus (Kg/mm$^2$) | 7,500 | 7,500 | 10,500 | 8,200 |
| 0.2% yield strength (Kg/mm$^2$) | 42 | 32 | 28 | 35 |

Note:
*1 0.2 to 0.8% Si, 3.5 to 4.5% Cu, 0.4 to 0.8% Mg, ≦0.5% Fe, Al balance
*2 12 to 15% Si, 1.5 to 1.5% Ni, 0.75 to 1.25% Mg, 0.5 to 1% Cu, Al balance.
*3 68.5 to 71.5% Cu, ≦0.05% Fe, ≦0.05% Pb, Zn balance.
*4 10.0 to 11.5% Si, 2.0 to 3.0% Cu, 0.2 to 0.5% Mg, ≦0.5% Fe and Al balance, (AHS : Aluminium High Strength).

In order not to decrease the constraining force when the temperature of the entire rolling roll rises by t° C., it is necessary that the axial expansion of the sleeve and spacer should be equal to or larger than the axial expansion of a part of the rolling roll corresponding to the length of the sleeve and the spacer. Namely, the following expression should be satisfied:

$$\alpha_1 \cdot l_1 \cdot t-\alpha_2 \cdot l_2 \cdot t \geqq \alpha_3 (l_1-l_2)\, t \qquad (1)$$

wherein the linear expansion coefficient and the length of the sleeve and the spacer are $\alpha_1$, $l_1$; $\alpha_2$, $l_2$, respectively, and the linear expansion coefficient of the rolling roll body is $\alpha_3$.

From the expression (1) a ratio of the length $l_1$ of the sleeve and the length $l_2$ of the spacer becomes as follows:

$$\frac{l_2}{l_1} \geqq \frac{\alpha_3-\alpha_1}{\alpha_2-\alpha_3} \qquad (2)$$

Each of the sleeve and the spacer is not necessary to be of one piece. They each can be made of n pieces. However, the length $l_1$ and $l_2$ of the sleeve and the spacer each are necessary to be satisfied with the following equations:

$$l_1 = \sum_{i=1}^{n} l_{1i},\ l_2 = \sum_{i=1}^{n} l_{2i} \qquad (3)$$

Embodiments

An Embodiment of the present invention will be described hereunder in detail referring to FIGS. 1 and 2.

In FIG. 1 showing a ceramic sleeve incorporated rolling roll, an arbor 1, as a rolling roll body, which is made of structural steel of a linear expansion coefficient $\alpha_3$ of $12.0\times10^{-6}$° C.$^{-1}$ has a flange 5 formed thereon, a screw portion 7 which is axially spaced from the flange 5 and a clutch 6 on one end portion thereof. The arbor 1 has a full length of 340 mm and a maximum diameter of 50 mm except for one of the flange 5, for example. A sleeve 4 is made of sialon ceramics of a linear expansion coefficient $\alpha_1$ of $3.4\times10^{-6}$° C.$^{-1}$ and has an outer diameter of 80 mm and an inner diameter of 55 mm which is larger by 5 mm than the outer diameter 50 mm of the arbor 1, whereby an annular gap 401 is formed between the arbor 1 and the sleeve 4. Both ends of the sleeve 4 each are formed in a tapered face 402, and the length of the sleeve 4 except for the tapered portion is 45 mm. The spacer 3 consists of two pieces 3 in this example so as to be disposed at the both ends of the sleeve 4, each spacer piece 3 is made of duralumin as mentioned previously of a linear expansion coefficient $\alpha_2$ of $23.5\times10^{-6}$° C.$^{-1}$. An end of each spacer piece 3 has a stepped portion 301 and the other end a tapered portion 302 so as to be in contact intimately with the tapered end 402 of the sleeve 4. Each of the spacer pieces 3 has an outer diameter of 75 mm, an inner diameter of 50 mm and length of 17 mm at the shortest part other than the tapered portion 302 and the stepped portion 301. In order to fix the sleeve 4 and the spacers 3 to the arbor 1 so as to be symmetrically with respect to a central axis of the arbor 1, a threaded flange-shaped fastener 2 is employed and screwed on the screw portion 7 of the arbor 1 thereby to press the sleeve 4, and the spacers 3 on the flange 5. The threaded flange-shaped fastener is made of the same material as the arbor 1 and in the same shape with the flange 5. The fastener 2 and flange 5 have stepped portions 201, 501 respectively, to intimately engage with the stepped portions 301 of the spacers 3 whereby the concentricity between the arbor 1 and the sleeve can be kept even when the spacers 3 are expanded. As fixing methods, shrinkage fit, press fit, adhesion, etc. can be employed other than the above-mentioned screw method.

It will be checked whether or not the above constructed rolling roll 10 is satisfied with the expression (2)

$$l_2/l_1=17\times2/45=0.756,$$

$$(\alpha_3-\alpha_1)/(\alpha_2-\alpha_3)=0.748,$$

that is, $0.756>0.748$.

Further, the fastener 2, the spacer 3, the sleeve 4 and the flange 5 of the arbor 1 each have tapered portion or stepped portion formed symmetrical with respect to the axes of them in order that they are concentric with each other. However, any other means can be provided as long as they are suitable to cause the sleeve, the spacer and the arbor 1 to be concentric with each other.

Figure 3:
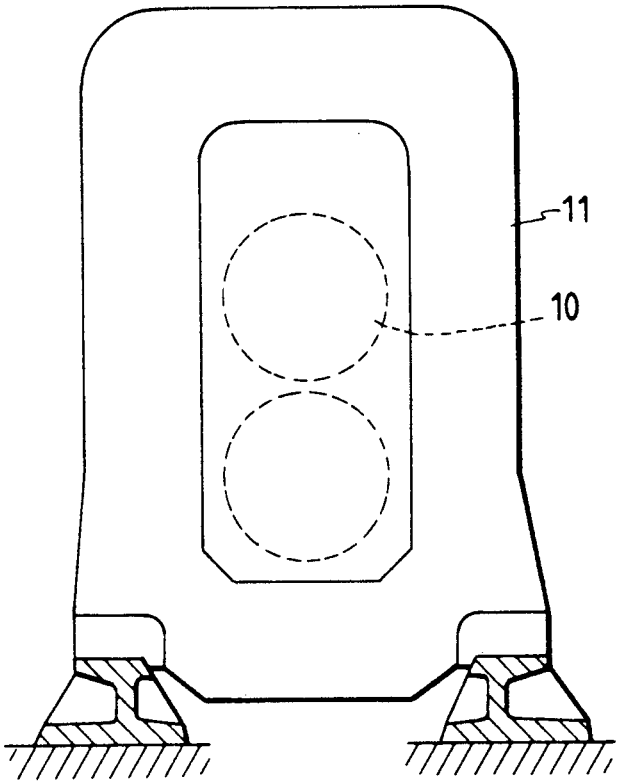
FIG. 3 is a front view of a rolling mill in which the ceramic sleeve incorporated rolling rolls are employed for working rolls.

The rolling roll 10 is employed in a two-high rolling mill, for example. The two high rolling mill as shown in FIG. 3 comprises a housing 11 and a pair of working rolls rotatably supported by the housing 11. The working rolls each are the same as the rolling roll 10.

When the roll 10 is driven through the clutch 6, a frictional force is produced between a material to be rolled and the working surface of the sleeve 4. The frictional force works so as to rotate the sleeve 4 separately from the spacer 3 and the arbor 1, so that a knock pin (not shown) or other means having an equivalent effect to one of the knock pin can be employed between the spacer and the sleeve to prevent relative rotation therebetween, if necessary.

The knock pin may be provided at an abutment between the spacer 3 and the sleeve 4. In such a case, a groove of the sleeve 4 for the knock pin should be shaped in partial arc or in a part of parabola so that a shape factor should be made small because the sleeve 4 is of brittle material.

The following two experiments were conducted on the above constructed rolling roll 10.

Experiment (1)

The rolling roll 10 is supported at two journal portions positioned at the outside of the flange 5 and the fastener 2, a load of 10 Kg is loaded perpendicularly at the center of the sleeve 4, and an indicator as a deformation meter is set at the center of the sleeve 4 on the opposite side to the load. The rolling roll 10 was heated at a rate of 10° C./h, and a relationship between the temperature and the deflection (μm, expressed as a radial deformation) of the sleeve was obtained. The result of the present invention is shown in FIG. 2, comparing with an experimental result and calculated values of a conventional rolling roll in which a sleeve is directly fixed by a flange and a fastener to an arbor without employing any spacer. From the results shown in FIG. 2, it is noted that any deflection of the sleeve 4 does not take place in the rolling roll according to the present invention. However, in the conventional rolling roll without any spacer or conventional rolling roll in which the spacer is made of the same material as the arbor, it is noted that deflection takes place because the linear expansion coefficient of the sialon ceramics is smaller than that of the structural steel, and an axial gap takes place between the sleeve and the spacer when the temperature of the rolling roll rises, whereby the deflection is caused by the load applied to the sleeve. According to the calculation of the deflection, the deflection increase linearly according to increase of the temperature, while in the measured result, any deflection does not take place until the roll reaches to a temperature of 40° C. or a temperature difference between a temperature of the roll at the time of assemblage and a temperature of the roll at the time of test reaches to 25° C. This is because compressive stress is applied in the sleeve 4, the spacer 3 and the flange 5 by screwing the fastener 2 and tensile stress is applied in the arbor 1, so that it seems that the gap is not formed until the strain is released.

Experiment (2)

Cold rolling of copper foil, brass foil, bronze foil, 42 alloy foil, etc. is effected by the two-high rolling mill in which the rolling rolls 10 formed according to the embodiment are employed. As a result, it is found that the rolling is effected with the thickness preciseness within allowable tolerance less than 0.5 μm. The temperature of the roll rises and often reaches to a temperature of more than 100° C. even during cold rolling because there is heat generation in the bearings, heat due to deformation of the material to be rolled and frictional heat caused between the material to be rolled and the roll.

Figure 2:
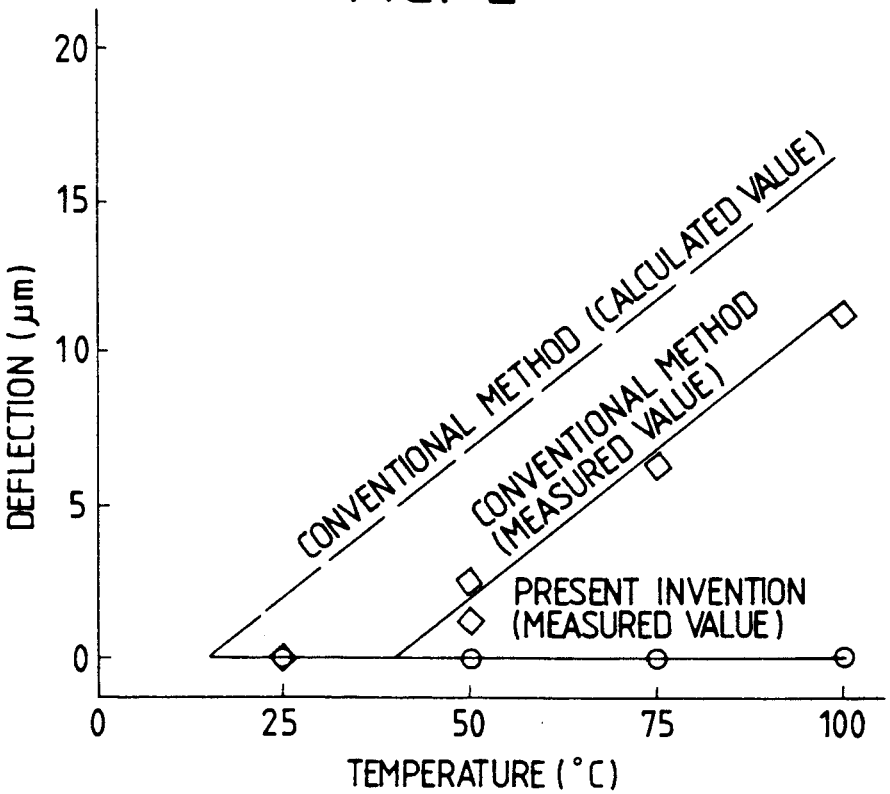
FIG. 2 is a graphical illustration showing experimental results of a loading test.

In rolling using the above-mentioned conventional rolling rolls, precise rolling can not be effected because there is deflection of the sleeve as shown in FIG. 2. Additionally, the material contacting with the sides of the sleeve 4 wears, so that a sufficient constraining force can not be obtained even in case of a low temperature.

Another embodiment of the present invention will be described hereunder.

Although in the previously mentioned embodiment, the sialon ceramics is used for material of the sleeve 4, in this embodiment zirconia which is relatively large in a thermal expansion coefficient of ceramics and has excellent strength and toughness is used as material of the sleeve 4.

Namely, the sleeve 4 is made of zirconia of a linear expansion coefficient $\alpha_1$ of $9.2\times10^{-6}$° C.$^{-1}$ and has an length of 60 mm. The same spacer 3 as in the previous embodiment is used, that is, the spacer 3 consists of two pieces of duralumin and the two spacer pieces are disposed at both sides of the sleeve 4. The length of each of the spacer pieces is 10 mm. The other parts, their material and an assembling method are the same as in the previous embodiment.

In the rolling roll constructed of the abovementioned parts according to the assembling method, it is checked whether or not the constraining force of the sleeve 4 decreases when the temperature of the roll rises. As a result, the left side of the expression (2) is 0.333 while the right side is 0.244, so that the expression (2) is satisfied. The same experiment as shown in FIG. 2 was conducted using the rolling roll as mentioned on this embodiment. As a result, any deflection does not take place even when the temperature of the rolling roll rises. It is confirmed that the rolling roll also has the previously mentioned effect.

According to the present invention, the ceramic sleeve incorporated rolling roll can be prevented to be broken. The constraining force of the sleeve does not decrease even when the rolling roll temperature rises, so that precise rolling is effected because of no deflection of the sleeve.

The invention can be applied to a wear-resistant material of a low thermal expansion coefficient such as sintered hard alloys, or cermet other than the ceramics.

In particular, according to the present invention, a ceramic member is joined to a member of material such as metal the thermal expansion coefficient of which is larger than the ceramics, and when it is used at a temperature higher than one at a time of their assemblage, it is very effective because of no loosening. For an appropriate range of linear expansion coefficient ($\alpha$) for the spacer, the arbor, and the ceramic material, it is sufficient for $\alpha_2$ (spacer)$>\alpha_3$ (arbor)$>\alpha_1$ (sleeve) Ceramic material which can be used for the sleeve also includes $ZrO_2$, $Al_2O_3$, SiC, and $Si_3N_4$, respectively, having a linear expansion coefficient of 9.5, 7.9, 4.2 and 3.4 ($\times10^{-6}$/° C.).

We claim:

1. A ceramic sleeve incorporated rolling roll for a rolling mill, comprising:

a metal rolling roll body having a flange portion thereon and a threaded portion axially spaced from said flange portion;

a ceramic sleeve having a working surface at an outer periphery thereof, in which said metal rolling roll body is inserted with an annular gap formed between an outer periphery of said metal rolling roll body and an inner periphery of said ceramic sleeve, said ceramic sleeve having a thermal expansion coefficient smaller than that of said metal rolling roll body;

a pair of cylindrical spacer members each having a larger thermal expansion coefficient than said metal rolling roll body and disposed on said metal rolling roll body at each end of said ceramic sleeve for adjusting thermal expansion so that the thermal expansion of said ceramic sleeve and said spacer members are substantially equal to or slightly larger than that of said metal rolling roll body between said flange portion and said threaded portion;

a threaded flange-like fastener screwed on said threaded portion to axially press said pair of spacer members and said sleeve against said flange portion whereby said sleeve is fixed to said metal rolling roll body;

annular recesses formed by said metal rolling roll body and by stepped portions of said flange portion of said metal rolling roll body and of said fastener, respectively, said annular recesses each being defined by an outer peripheral surface of said metal rolling roll body and an inner periphery of a stepped portion; and axially extending annular projections formed on said spacer members, and intimately engaged in said annular recesses.

2. A ceramic sleeve incorporated rolling roll according to claim 1, wherein said ceramic sleeve has tapered faces on both axial ends thereof so that a distance between said tapered faces decreases gradually toward an outer periphery thereof, and said spacer members each have a tapered face intimately contacting one of said tapered faces of said ceramic sleeve.

3. A ceramic sleeve incorporated rolling roll according to claim 2, wherein said spacer members each are made of material selected from the group consisting of duralumin, Lo-Ex, brass, AHS (Aluminum high strength) and Al-C fiber compound metal.

4. A ceramic sleeve incorporated rolling roll according to claim 3, wherein said annular projection of each of said spacer members has an inner periphery, the diameter of which is substantially the same as that of the outer periphery of said metal rolling roll body inserted in said spacer member.

5. A ceramic sleeve incorporated rolling roll according to claim 3, wherein said rolling roll body is made of steel.

6. A ceramic sleeve incorporated rolling roll comprising:

a metal rolling roll body having a flange portion integrally formed thereon and a fixing portion axially spaced from said flange portion;

a ceramic sleeve, having a working surface at an outer periphery thereof, into which said roll body is inserted with a gap therebetween, said sleeve being made of a material having a smaller coefficient of thermal expansion than that of said roll body and having tapered faces on both axial ends thereof so that a distance between said tapered faces decreases gradually toward an outer periphery thereof;

a fastener fixedly mounted on said fixing portion of said roll body for pressing end faces of said sleeve to fix said sleeve to said roll body;

two spacer members each having a larger coefficient of thermal expansion than that of said roll body, with one spacer member inserted between said sleeve and said fastener and the other spacer member inserted between said sleeve and said flange portion so that said sleeve is pressed by said fastener via said spacer members, said spacer members each having on one end thereof a tapered face intimately contacting with a tapered face of said sleeve;

axially extending recesses formed in said flange portion of said metal rolling roll body and in said fastener, respectively, said recesses and an outer peripheral surface of said metal rolling roll body forming annular recesses facing other ends of said spacer members;

said spacer members each having axially extending annular projections formed on said other ends, which projections are intimately inserted into said annular recesses.

7. A rolling mill having a housing and a pair of working rolls each rotatably supported by said housing, said working rolls each comprising:

a metal rolling roll body having a flange portion thereon and a threaded portion axially spaced from said flange portion;

a ceramic sleeve, having a working surface at an outer periphery thereof, into which said roll body is inserted with a gap therebetween, said sleeve being made of material having a smaller coefficient of thermal expansion than that of said roll body;

a fastener screwed on said threaded portion of said roll body for fixing said sleeve to said roll body;

two spacer members each having a larger coefficient of thermal expansion than that of said roll body and inserted between said sleeve and said fastener and between said sleeve and said flange portion, respectively, so that said sleeve is pressed by said fastener via said spacer members, whereby said sleeve is fixed to said roll body;

annular recesses formed by said roll body and by stepped portions of said flange portion of said roll body and said fastener, respectively, said annular recesses each being defined by an outer peripheral surface of said roll body and an inner periphery of a stepped portion; and axially extending annular projections formed on said spacer members and intimately engaged in said annular recesses.

8. A rolling mill according to claim 7, wherein said ceramic sleeve has tapered faces on both axial ends thereof so that a distance between said tapered faces decreases gradually toward an outer periphery thereof, and said spacer members each have a tapered face intimately contacting with a tapered face of said ceramic sleeve.

9. A rolling mill according to claim 8, wherein said spacer members each are made of material selected from the group consisting of duralumin, Lo-Ex, brass, AHS (Aluminum high strength) and Al-C fiber compound metal and said roll body is made of steel.

10. A rolling mill according to claim 7, wherein said tapered faces of said spacer members, the tapered faces of said ceramic sleeves, the annular recesses defined by said flange portion and said fastener and the roll body and the annular projections of said spacer members cooperate to keep the ceramic sleeve concentric with said roll body during rolling of metal on said mill.

* * * * *